United States Patent [19]

Mizuhara

[11] Patent Number: 4,552,057

[45] Date of Patent: Nov. 12, 1985

[54] THERMALLY INSULATED PISTON

[75] Inventor: Howard Mizuhara, Hillsborough, Calif.

[73] Assignee: GTE Products Corporation, Stamford, Conn.

[21] Appl. No.: 567,193

[22] Filed: Dec. 30, 1983

[51] Int. Cl.[4] ..... F04B 31/08

[52] U.S. Cl. ..... 92/176; 92/212; 92/224; 92/231; 92/260

[58] Field of Search ..... 92/176, 212, 224, 231, 92/260, 222; 123/193 P, 668, 669; 29/156.5; 228/56, 122, 178

[56] References Cited

U.S. PATENT DOCUMENTS

| | | | |
|---|---|---|---|
| 1,407,202 | 2/1922 | Kubler | 92/224 X |
| 1,482,778 | 2/1924 | Bowmar | 92/176 |
| 1,490,849 | 4/1924 | Philip | 92/212 X |
| 1,700,604 | 1/1929 | Wagener | 92/231 X |
| 2,058,741 | 10/1936 | Taylor | 92/231 X |
| 2,537,174 | 1/1951 | Townhill | 92/176 X |
| 3,408,995 | 11/1958 | Johnson | 123/668 |
| 3,613,521 | 10/1971 | Itano | 92/231 X |
| 4,242,948 | 1/1981 | Stang et al. | 92/176 X |

FOREIGN PATENT DOCUMENTS

| | | | |
|---|---|---|---|
| 366781 | 2/1932 | United Kingdom | 92/231 |

*Primary Examiner*—Edward K. Look
*Attorney, Agent, or Firm*—Donald R. Castle

[57] ABSTRACT

This invention discloses a thermally insulated piston having a cap portion and a body portion. The cap can be made of metal or ceramic. The cap and body portion are joined together by a brazing alloy. The cap portion can have a groove for receiving the brazing alloy. The ceramic cap can have a retaining band portion in a retaining band groove the band being bonded to the body portion by a brazing alloy. The piston with the ceramic cap can have an interlayer between the cap and body portion, the interlayer being bonded to the cap portion and body portion by a brazing alloy. The interlayer can have an outer knife edge. The body portion has a machined groove adjacent to the cap portion comprised of cells filled with thermal insulating material.

15 Claims, 3 Drawing Figures

THERMALLY INSULATED PISTON

BACKGROUND OF THE INVENTION

This invention relates to internal combustion engine pistons and more particularly to a thermally insulated piston which restricts flow of heat from the combustion chamber through the piston body.

The efficiency of internal combustion engines, and in particular diesel engines, is improved by retaining heat from the ignited fuel in the combustion chamber of the cylinder by minimizing heat loss through the piston. This has been done in the past by insulating the piston cap by various techniques described below. A major problem, however, has been in the method of holding the ceramic cap in place under operating conditions. To date, no reliable bond between the curved surfaces of the ceramic member and the piston body has been devised.

U.S. Pat. No. 4,242,948 describes a piston which uses a metal bolt to attach a ceramic cap to the piston body. The metal bolt, however, expands during operation and tends to loosen the connection of the cap to the piston body. Any ceramic chip between the cap and the piston body will cause the cap to break when the engine cools to room temperature and the bolt shrinks. Another proposal is to shrink fit a carefully ground ceramic liner into a steel piston cap. This construction is susceptible to failure from ceramic cracks due to the irregular shear force which exceeds the mechanical property of the ceramic material.

In general, success in insulating pistons with ceramic material has been limited because of the difficulty of attaching the ceramic piece to the metal piston body without adversely stressing the ceramic piece during operation of the engine.

Application Ser. No. 495,849 provides a thermally insulated piston constructed without the use of ceramic inserts or the like. It describes the use of a honeycomb internal support insulation.

The insulated piston described in this disclosure is a more cost effective design.

SUMMARY OF THE INVENTION

In accordance with one aspect of this invention there is disclosed a thermally insulated piston having a cap portion and a body portion. The cap can be made of metal or ceramic. The cap and body portion are joined together by a brazing alloy. The cap portion can have a groove for receiving the brazing alloy. The ceramic cap can have a retaining band portion in a retaining band groove the band being bonded to the body portion by a brazing alloy. The piston with the ceramic cap can have an interlayer between the cap and body portion, the interlayer being bounded to the cap portion and body portion by a brazing alloy. The interlayer can have an outer knife edge. The body portion has a cellular portion adjacent to the cap portion comprised of machined cells filled with thermal insulating material. The cellular portion can also be achieved by drilling number of holes with minimum wall area.

The previously described and other features of the invention will be apparent from a reading of the following description of the disclosure shown in the accompanying drawings and the novelty thereof pointed out in the appended claims.

DETAILED DESCRIPTION OF THE INVENTION

Figure 1:
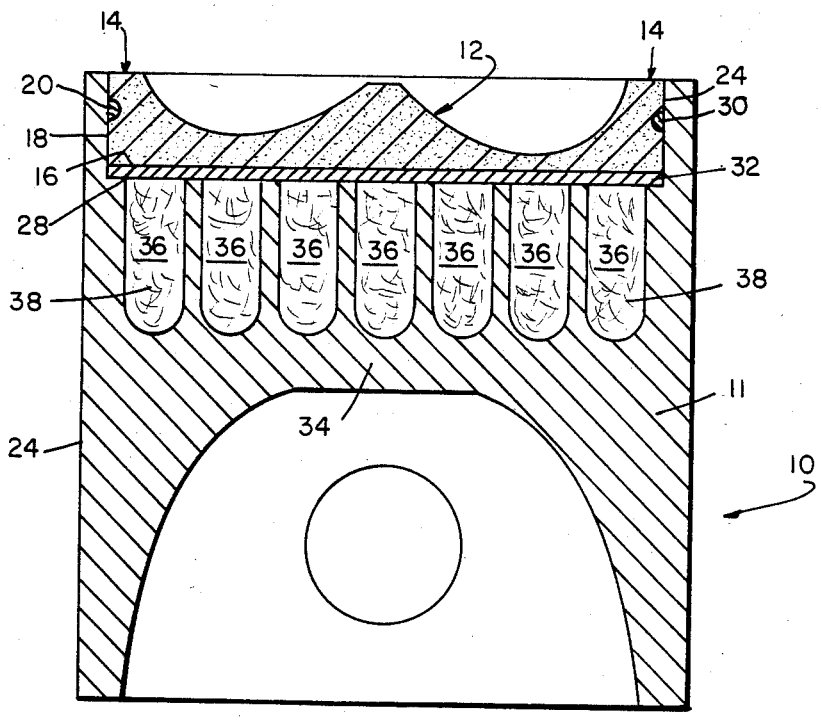
FIG. 1 is a cross sectional view illustrating one embodiment of this invention.

Referring to the drawings, FIG. 1 depicts a preferred embodiment of the invention which comprises a piston 10 having a portion body 11 and a cap portion 12 which are generally constructed of metal. It is preferred that the material of the cap portion 12 be the same material as that of the body portion 11 in order to have matched expansion properties; and the preferred material is cast iron. The cap portion 12 has an outer surface 14 and an inner planar surface 16, and a periphery surface 18 in which is a brazing alloy receiving groove 20. The body portion 11 has a substantially circular periphery 24 and a recess for receiving the cap 12. The recess has a first surface 28 opposing the inner planar surface 16 of the cap 12. The body portion 11 and the cap portion 12 are joined together by a first brazing alloy 30 positioned in the brazing alloy receiving groove 20 and by a second brazing alloy 32 positioned between the inner planar surface 16 of the cap portion 12 and the first surface 28 of the recess 26. The body portion 11 has a cellular portion 34 adjacent to the cap 12 comprised of a cells 36 filled with a thermal insulating material 38. It is preferred that the first 30 and second 32 brazing alloys have a flow temperature of from about 600° C. to about 1000° C. The first 30 and second 32 brazing alloys can consist of preferably by weight (1) from about 20% to about 50% copper, from about 5% to about 20% indium, and from about 50% to about 80% silver; or (2) from about 60% to about 80% copper, from about 20% to about 40% manganese, and from about 1% to about 10% cobalt. The alloys can be the same material or different materials, however, if different compositions the brazing temperature should be approximately the same so that the materials will braze at the same temperature.

Figure 2:
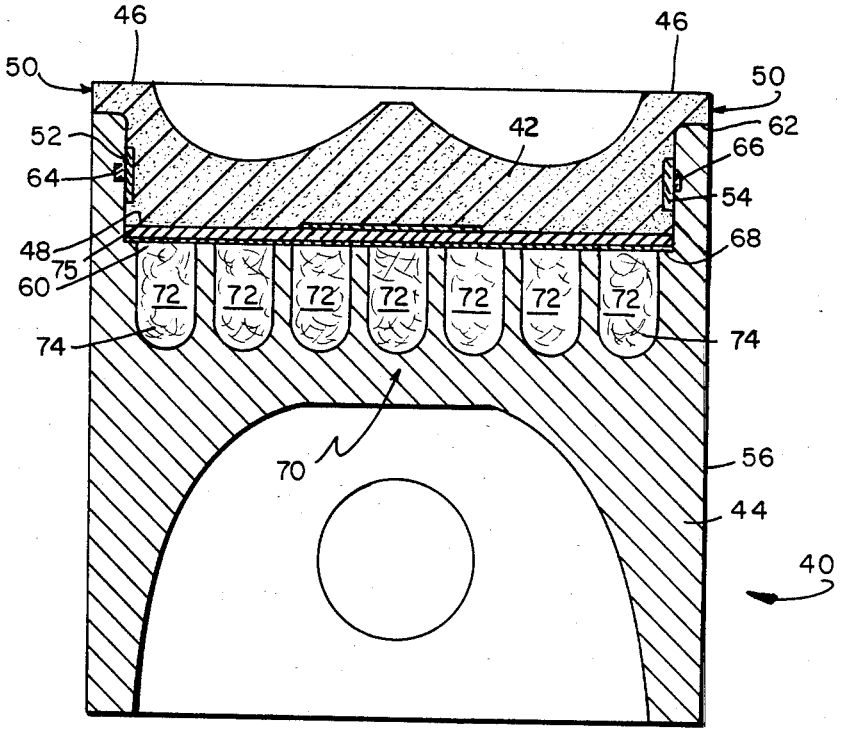
FIG. 2 is a cross sectional view illustrating another embodiment of this invention.

FIG. 2 depicts another embodiment of the invention which comprises a piston 40 having a cap portion 42 which is generally constructed of a ceramic material preferably partially stabilized zirconia, silicon nitride, cordierite and aluminate; and a body portion 44 which is generally constructed of metal preferably cast iron. The cap portion 42 has an outer surface 46 and an inner planar surface 48 and a periphery surface 50 extending from the inner surface 48 to the outer surface 46. The periphery surface 50 has a retaining band groove 52 in which is positioned a retaining band 54 which is generally constructed of steel. The body portion 44 has a substantially circular periphery 56 and a recess for receiving the cap portion 42. The recess has a first surface 60 opposing the inner planar surface 48 of the cap portion 42 and a second surface 62 opposing a portion of the periphery surface 50 of the cap 42. The body portion 44 has a brazing alloy receiving groove 64. The body portion 44 and the cap portion 42 can be joined together by a first brazing alloy 66 postioned in the alloy receiving groove 64 which metallurgically bonds the body portion 44 and the retaining band 54; and a second brazing alloy 68 which is positioned between the inner planar surface 48 of the cap 42 and the first surface 60 of the recess 58. The first 66 and second 68 brazing alloys preferably consist essentially of by weight (1) from about 20% to about 50% copper, from about 5% to about 20% indium, and from about 50% to about 80% silver; and (2) from about 10% to about 50% copper, from about 5% to about 30% zinc, and from about 10% to about 70% silver. The body portion 44 has a cellular portion 70 adjacent to the cap 42 and comprised of cells 72 filled with a thermal insulating material 74. Alternatively, a steel disc 75 is brazed to cover the cells 72. When the ceramic cap portion 42 is retained by the steel retaining band 54 it is not necessary to braze the inner surface 48 of the cap portion 42 to the steel disc 75. While preferably the first and second brazing alloys are the same composition, it is not essential as long as they have similar brazing temperatures.

Figure 3:
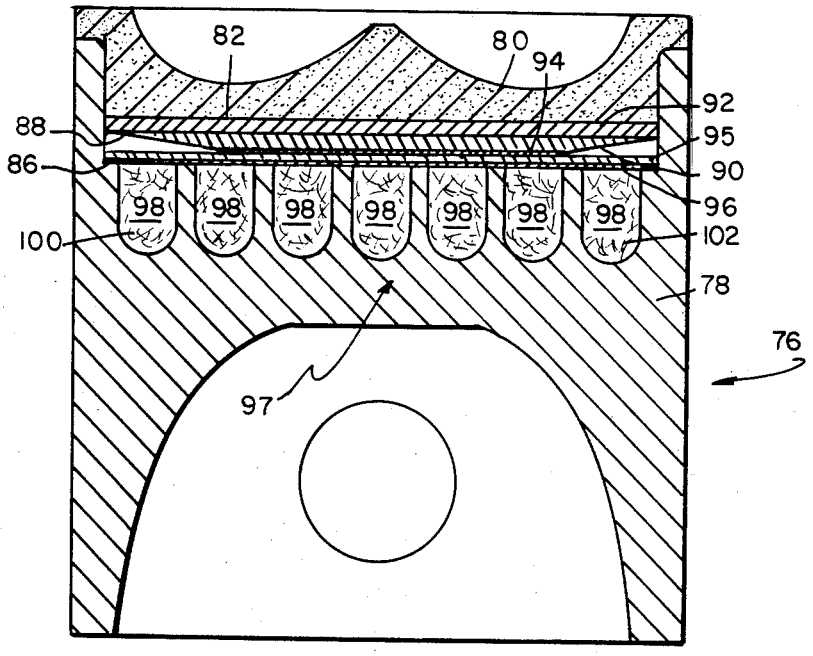
FIG. 3 is a cross sectional view illustrating another embodiment of this invention.

FIG. 3 depicts another embodiment of the invention which comprises a piston 76 having a main body portion 78 and a cap portion 80. The main body portion 78 and cap portion 80 are constructed of the same materials as the respective parts of the piston 40 described in FIG. 2. The cap portion 80 has an inner planar surface 82. The body portion 78 has a recess for receiving the cap portion 80. The recess has a first surface 86 opposing the inner planar surface 82 of the cap portion 80. There is an interlayer 88 between the inner planar surface 82 of the cap 80 and the first surface 86 of the body portion 78. The interlayer 88 has an outer knife edge 90. The knife edge design allows metal deformation without fracturing the ceramic. The cap portion 80 and the interlayer 88 are bonded together by a first brazing alloy 92 and the interlayer 88 and the body portion 78 are bonded together by a combination of a second brazing alloy 94, a steel disc 95 and a third brazing alloy 96. The first brazing alloy 92 and second brazing alloy 94 generally consisting essentially of the following composition in percent by weight: from about 60% to about 90% silver, from about 10% to about 40% copper, and from about 0.5% to about 5% titanium, from about 60% to 90% silver and from 10% to about 40% copper. The body portion 78 has a machined cellular portion 97 adjacent to the third brazing alloy 96. The cellular portion is comprised of cells 98 filled with a thermal insulating material 100.

Where there has been shown and described what are considered the preferred embodiments of the invention, it will be obvious to those skilled in the art that various changes and modifications may be made therein without departing from the scope of the invention as defined by the appended claims.

What is claimed is:

1. A piston comprising:

(a) a cap portion having an outer surface and an inner planar and a periphery surface extending from said inner surface to said outer surface, said periphery surface having a brazing alloy receiving groove therein, (b) a body portion having a substantially circular periphery, said body portion having a recess for receiving said cap portion, said recess having a first surface opposing said inner planar surface of said cap portion, said body portion and said cap portion being joined together by a first brazing alloy positioned in said groove and by a second brazing alloy positioned between said inner planar surface of said cap and said first surface of said recess, said body portion having a cellular portion adjacent to said second brazing alloy comprised of open-ended cells filled with a thermal insulating material said cells being closed by said brazing alloy and said cap portion.

2. A piston according to claim 1 wherein said cap portion is metal.

3. A piston according to claim 1 wherein said cap portion and said body portion are constructed of material of matching thermal expansion properties.

4. A piston according to claim 1 wherein the piston is constructed of cast iron.

5. A piston according to claim 1 wherein said first and second brazing alloy have a flow temperature of from about 600° C. to about 1000° C.

6. A piston according to claim 1 wherein said brazing alloys are selected from the group consisting of copper and silver based alloys wherein said alloy are compositions selected from a composition consisting essentially of from about 20% to about 50% by weight copper, from about 5% to about 20% by weight indium, and from about 50% to about 80% by weight silver and a composition consisting essentially of from about 50% to about 80% by weight copper, from about 20% to about 40% by weight of manganese, and from about 1% to about 10% by weight of cobalt.

7. A piston comprising:

(a) a cap portion having an outer surface and an inner planar surface and a periphery surface extending from said inner surface to said outer surface, said periphery surface having a retaining band groove, (b) a retaining band positioned in said retaining band groove and, (c) a body portion having a substantially circular periphery, said body portion having a recess for receiving said cap portion, said recess having a first surface opposing said inner planar surface of said cap portion and a second surface opposing a portion of said periphery surface of said cap portion having a brazing alloy receiving groove therein, said body portion and said cap portion being joined together by a first brazing alloy positioned in said alloy receiving groove and metallurgically bonding said body portion and said retaining band and by a second brazing alloy positioned between said inner planar surface of said cap and said first surface of said recess, said body portion having a cellular portion adjacent to said second brazing alloy comprised of open-ended cells filled with a thermal insulating material said cells being closed by said brazing alloy and said cap portion.

8. A piston according to claim 7 wherein said cap portion is a ceramic material.

9. A piston according to claim 8 wherein the ceramic material of said cap portion is selected from the group consisting of partially stabilized zirconia, silicon nitride, cordierite, and alumina.

10. A piston according to claim 7 wherein said body portion is constructed of metal.

11. A piston according to claim 10 wherein said body portion is constructed of cast iron.

12. A piston according to claim 7 wherein said brazing alloys are selected from the group consisting of a composition consisting essentially of, in percent by weight, from about 50% to about 80% copper, from about 5% to about 20% indium, and from about 50% to about 80% silver; and a composition consisting essentially of in percent by weight from about 50% to about 80% copper, from about 20% to about 40% manganese, and from about 1% to about 20% cobalt.

13. A piston according to claim 7 wherein said retaining band is constructed of steel.

14. A piston according to claim 7 wherein a second brazing alloy metallurgically bonds said inner planar surface of said cap to said first surface of said recess.

15. A piston according to claim 14 wherein a steel disc is intermediate between said second brazing alloy and said cap portion.

* * * * *